US011572882B2

(12) United States Patent
Pecheanu

(10) Patent No.: US 11,572,882 B2
(45) Date of Patent: Feb. 7, 2023

(54) CENTRIFUGAL AIR COMPRESSOR AND CONTROL

(71) Applicant: PECHEANU AIR COMPRESSORS INC., Stoney Creek (CA)

(72) Inventor: Cristinel Antoniu Pecheanu, Stoney Creek (CA)

(73) Assignee: Pecheanu Air Compressors Inc., Stoney Creek (CA)

( * ) Notice: Subject to any disclaimer, the term of this patent is extended or adjusted under 35 U.S.C. 154(b) by 0 days.

(21) Appl. No.: 17/639,700

(22) PCT Filed: Aug. 18, 2021

(86) PCT No.: PCT/CA2021/051144
§ 371 (c)(1),
(2) Date: Mar. 2, 2022

(87) PCT Pub. No.: WO2022/032399
PCT Pub. Date: Feb. 17, 2022

(65) Prior Publication Data

US 2022/0268286 A1 Aug. 25, 2022

Related U.S. Application Data

(60) Provisional application No. 63/084,540, filed on Sep. 28, 2020.

(51) Int. Cl.
*F04D 31/00* (2006.01)
*F04D 17/18* (2006.01)
(Continued)

(52) U.S. Cl.
CPC ..... *F04D 17/18* (2013.01); *F04C 19/00* (2013.01); *F04D 31/00* (2013.01); *F04C 19/005* (2013.01);
(Continued)

(58) Field of Classification Search
CPC ..... F04F 5/14; F04F 5/24; F04F 5/42; F05D 2210/132; F04C 19/00; F04C 19/006;
(Continued)

(56) References Cited

U.S. PATENT DOCUMENTS 1,144,865 A 6/1915 Rees
2,025,037 A 12/1935 Bergmann
(Continued)

FOREIGN PATENT DOCUMENTS

DE 823478 12/1951
WO 2016061164 A1 4/2016

OTHER PUBLICATIONS

International Search Report and Written Opinion Application No. PCT/CA2021/051144 dated Nov. 22, 2021; 12 pages.

*Primary Examiner* — Christopher Verdier
*Assistant Examiner* — Andrew J Marien
(74) *Attorney, Agent, or Firm* — John H. Thomas, P.C.

(57) ABSTRACT

A centrifugal gas compressor fed with a gas and a processing liquid comprises a rotor rotated by a prime mover. The rotor defines an internal axial cavity with a cylindrical surface, an annular peripheral collection cavity, and a tapered radial channel fluidly connecting the internal axial cavity and the annular peripheral collection cavity. With each rotation of the rotor, a portion of the processing fluid is swept into the inlet of the tapered radial channel and travels radially as a fluid piston under centrifugal force pushing and compressing a column of gas entrained in front of said fluid piston, and is expelled into the annular peripheral collection cavity where it undergoes centrifugal separation, leaving the compressed gas to be drawn off through the compressed gas outlet for downstream use. A method for compressing a gas is also provided.

17 Claims, 8 Drawing Sheets

(51) Int. Cl.

| | |
|---|---|
| ***F04C 19/00*** | (2006.01) |
| *F04D 1/00* | (2006.01) |
| *F04D 25/04* | (2006.01) |
| *F04D 25/06* | (2006.01) |
| *F04F 5/14* | (2006.01) |
| *F04F 5/24* | (2006.01) |
| *F04F 5/42* | (2006.01) |

(52) U.S. Cl.
CPC ..... *F04C 19/007* (2013.01); *F04C 19/008* (2013.01); *F04D 1/00* (2013.01); *F04D 25/045* (2013.01); *F04D 25/06* (2013.01); *F04F 5/14* (2013.01); *F04F 5/24* (2013.01); *F04F 5/42* (2013.01)

(58) Field of Classification Search
CPC ..... F04C 19/007; F04C 19/008; F04D 17/18; F04D 31/00; F04D 25/045; F04D 25/06; F04D 29/706
See application file for complete search history.

(56) References Cited

U.S. PATENT DOCUMENTS

| | | | | |
|---|---|---|---|---|
| 3,612,723 | A * | 10/1971 | van Staveren | F04D 17/18 417/67 |
| 9,618,013 | B2 | 4/2017 | Cherry | |
| 2014/0147244 | A1* | 5/2014 | Cantemir | F01C 7/00 415/191 |
| 2018/0023516 | A1* | 1/2018 | Zhang | F02M 21/0221 123/497 |
| 2019/0331138 | A1* | 10/2019 | Cherry | H02K 7/1823 |

* cited by examiner

CENTRIFUGAL AIR COMPRESSOR AND CONTROL

CROSS-REFERENCE TO RELATED APPLICATIONS

This is a National Stage Entry into the United States Patent and Trademark Office from International PCT Patent Application No. PCT/CA2021/051144, having an international filing date of Aug. 18, 2021, the contents of which is incorporated herein by reference in its entirety. By way of the PCT application, this application likewise claims the priority to U.S. Application No. 63/084,540, filed Sep. 28, 2020, the contents of which is incorporated herein by reference.

TECHNICAL FIELD OF THE INVENTION

This invention relates generally to centrifugal gas compressors, and particularly to a device and method for compressing gas using centrifugal forces in a plurality of radial channels leading radially to an annular collection cavity, and a system for controlling the pressure and/or flow rate of such compressed gas.

BACKGROUND OF THE INVENTION

Gas compressors are devices used extensively in industrial and consumer settings. The efficiency of current commercial gas compressors is relatively poor, mainly because the temperature of a gas increases significantly upon undergoing rapid compression. Rapid compression makes it nearly impossible to dissipate the heat of compression during the short time the gas spends inside the compressor. This heating of the gas during the compression process is undesirable: users generally require compressed gasses at ambient temperature. Despite this, most currently known compressors operate with adiabatic or semi-adiabatic compression cycles, simply because there is no easy way to completely and rapidly remove the compression heat at the compressor stage. Simply cooling the walls and the other metallic components of a conventional compressor is by far insufficient to remove such unwanted heat from the compressed gas output.

If isothermal compression could be achieved for a set pressure, the amount of compressed gas that can be generated for the same amount of mechanical work by the compressor could be almost doubled. There is an unmet need in the market today for an efficient compressor able to effect "isothermal compression", namely pressurizing the gas while removing all (or most of the) heat of compression. There is also a need for such compressors be simple, robust and relatively easy to service and operate.

Early centrifugal air compressor systems are known. U.S. Pat. No. 1,144,865 (Rees) discloses a rotary pump, condenser and compressor which used large cavities having highly curved walls and the cavities were not radial with respect to the rotating container. The compressor did not prevent the lateral travel of air bubbles in the outbound collection cavity. Air bubbles could be carried by their own buoyancy back toward the centre of the spinning compressor, decreasing efficiency and potentially stalling the compressor. The lateral motion of air bubbles would be analogous to leaking or improperly set piston rings in a conventional air compressor.

U.S. Pat. No. 9,618,013 (Cherry) teaches a centrifugal gas compressor having a rotatable container having a multiplicity of capillary tubes which lead radially to radially outboard ends terminating an a substantially annular container space. An emulsion of gas and liquid is fed into radially inboard ends of the capillary tubes. The rotation of the container causes formation of gas bubbles in the capillary tubes and compresses the gas bubbles in the tubes toward their radially outboard ends. The compressed gas bubbles are collection in a liquid/gas mix in the annular container space and the compressed gas is then drawn off. Capillary tubes are used to engineer bubble size (control diameter and prevent agglomeration of bubbles) and to prevent gas bubbles from finding a pathway around the radially inboard liquid. Each capillary is a micro-channel and has a small substantially uniform cross-section which causes formation of gas bubbles near radially inboard portions of the capillaries. The capillary dimensions are determined by the inner tube diameter to allow the air bubble to seal the tube and to prevent any liquid finding its way around the bubble (0.5 to 3.0 mm). However, the use of capillary tubes necessarily results in capillary forces effecting the flow of liquid and entrained air bubbles inside the micro-channels and ultimately requiring a higher energy input to overcome capillary forces. Moreover, the manufacturing cost of this centrifugal gas compressor would, be high having regard to the intricacy of assembling a multiplicity of capillary tubes, each of uniform cross section, into the rotatable container.

It is an object of the present invention to provide a centrifugal gas compressor which does not use micro-channels to engineer and control bubble size, thus eliminating the effect of capillary forces.

It is a further object of the present invention to provide a centrifugal gas compressor which does not require the use of circular channels of uniform cross-section to carry the liquid and entrained air bubbles.

It is a further object to provide a centrifugal gas compressor which is simpler and more cost effective to manufacture, yet which will operate in a highly energy efficient manner.

SUMMARY OF THE INVENTION

A centrifugal gas compressor fed with a gas and a processing liquid comprises a rotor rotated by a prime mover about an axis. The rotor defines an internal axial cavity with a cylindrical surface, an annular peripheral collection cavity, and a tapered radial channel fluidly connecting the internal axial cavity and the annular peripheral collection cavity. A fluid injector is located within the internal axial cavity and is oriented at a forward angle to direct a jet of processing liquid onto the cylindrical surface of the internal axial cavity to sweep the processing liquid along the cylindrical surface in front of a leading edge of the jet of processing liquid and toward an inlet of the tapered radial channel as the rotor rotates. A compressed gas outlet is defined within the annular peripheral collection cavity at a position proximate to an axial wall of the annular peripheral collection cavity. A liquid drain outlet within the annular peripheral collection cavity is positioned proximate to a peripheral wall the said annular peripheral collection cavity. With each rotation of the rotor, a portion of the processing fluid is swept into the inlet of the tapered radial channel and travels radially as a fluid piston under centrifugal force pushing and compressing a column of gas entrained in front of said fluid piston, and is expelled into the annular peripheral collection cavity and forms a peripheral liquid ring proximate to the peripheral wall of the annular peripheral collection cavity, leaving the compressed gas to be drawn off through the compressed gas outlet.

A gas inlet is positioned within the internal axial cavity of the rotor. The inlet of the tapered radial channel has a leading edge and a trailing edge defined with respect to the direction of rotation of the rotor. Preferably, the leading edge of the inlet is curved backward in relation to the direction of rotation of the rotor forming a widened fluid catchment area. The tapered radial channel is of rectangular cross section. The tapered radial channel is branched to form a plurality of tapered radial sub-channels.

A method is provided for compressing a gas fed in a rotor rotated by a prime mover about an axis, said rotor defines an internal axial cavity with a cylindrical surface. A tapered radial channel fluidly connects the internal axial cavity and the annular peripheral collection cavity. A jet of processing liquid is injected into the internal axial cavity oriented at a forward angle onto the cylindrical surface of the internal axial cavity to sweep the processing liquid along said cylindrical surface in front of a leading edge of the jet and toward an inlet of the tapered radial channel as the rotor rotates. With each rotation of the rotor, the jet of processing fluid sweeps a portion of the processing fluid into the inlet of the tapered radial channel causing the portion of processing fluid to travel radially as a fluid piston under centrifugal force pushing and compressing a column of gas entrained in front of the fluid piston. Each fluid piston and entrained column of gas travels radially through the radial channel to be expelled into the annular peripheral collection cavity. In the annular peripheral collection cavity the processing liquid, under centrifugal force, forms a peripheral liquid ring proximate to the peripheral wall of the annular peripheral collection cavity leaving the compressed gas to be drawn off through a compressed gas outlet located within the annular peripheral collection cavity at a position proximate to an axial wall of the annular peripheral collection cavity.

DETAILED DESCRIPTION OF THE INVENTION

Figure 1:
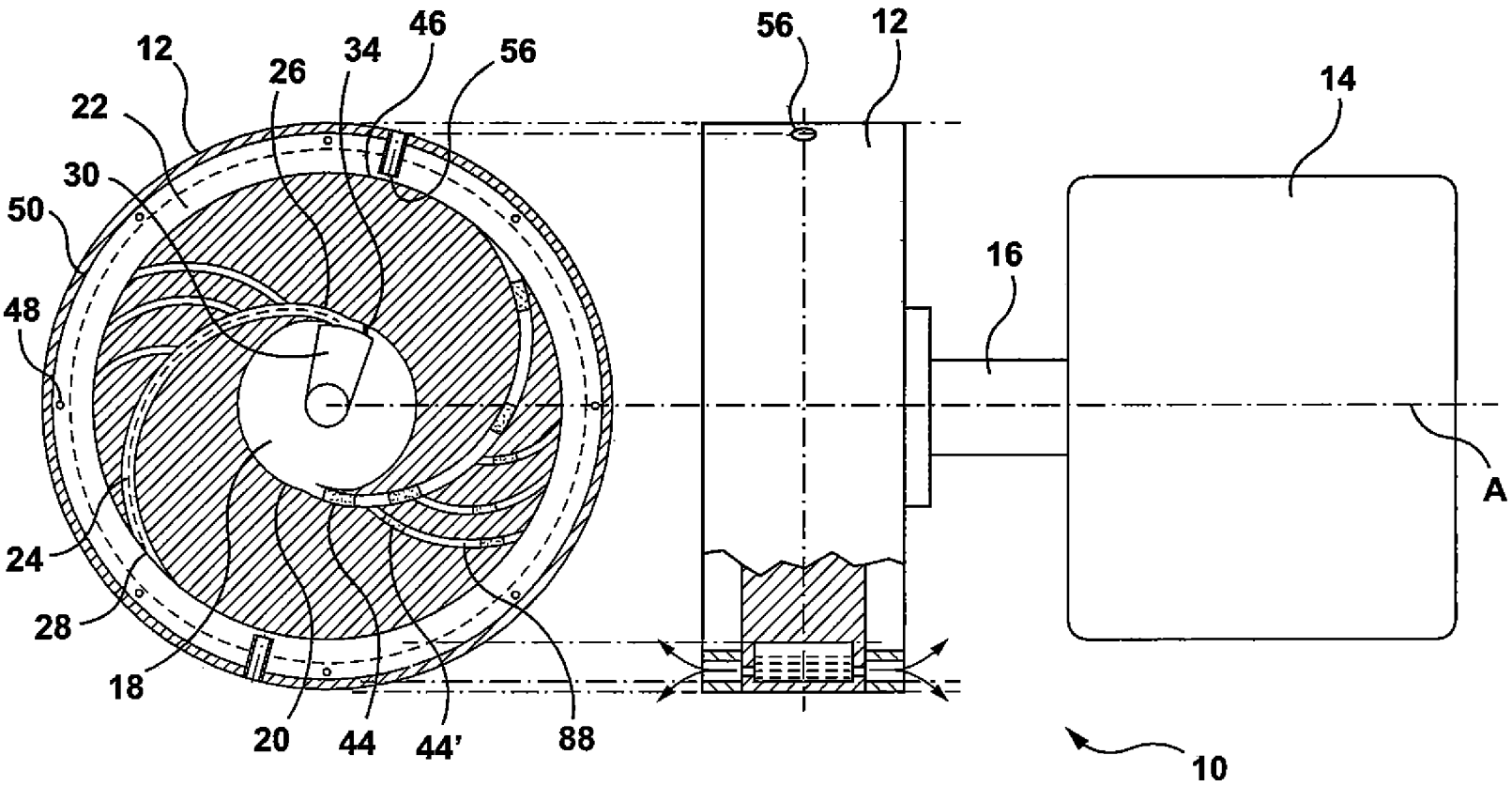
FIG. 1 is a multi-angle view of a preferred embodiment of this invention (shown during normal operation with injection of water and with the external housing removed from view, to enable a better understanding of the rotor's internal structure), showing a full cross-sectional front view of the rotor, and a partial sectional view from the right.

The present invention introduces a centrifugal gas compressor fed with a gas and a processing liquid. Reference is made in the following description and claims to a "gas" and a "processing liquid". Most often water is the processing liquid utilized in the present invention and the gas to be compressed is air. It should be understood that the teachings disclosed herein may also be applied to compress pure gases or other mixed gases, and that other processing liquids may be used so long as they act in a manner similar to water when exposed to exposed to centrifugal forces. A person skilled in the art will understand the selection of gases and processing liquids should be made having regard to their chemical properties and reactivity.

Certain terminology is used in the following description for convenience only and is not limiting. The words "lower," "bottom," "upper," and "top" designate directions in the drawings to which reference is made. The words "inwardly" and "outwardly,", "upwardly" and "downwardly", "axially" and "peripherally" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 8:
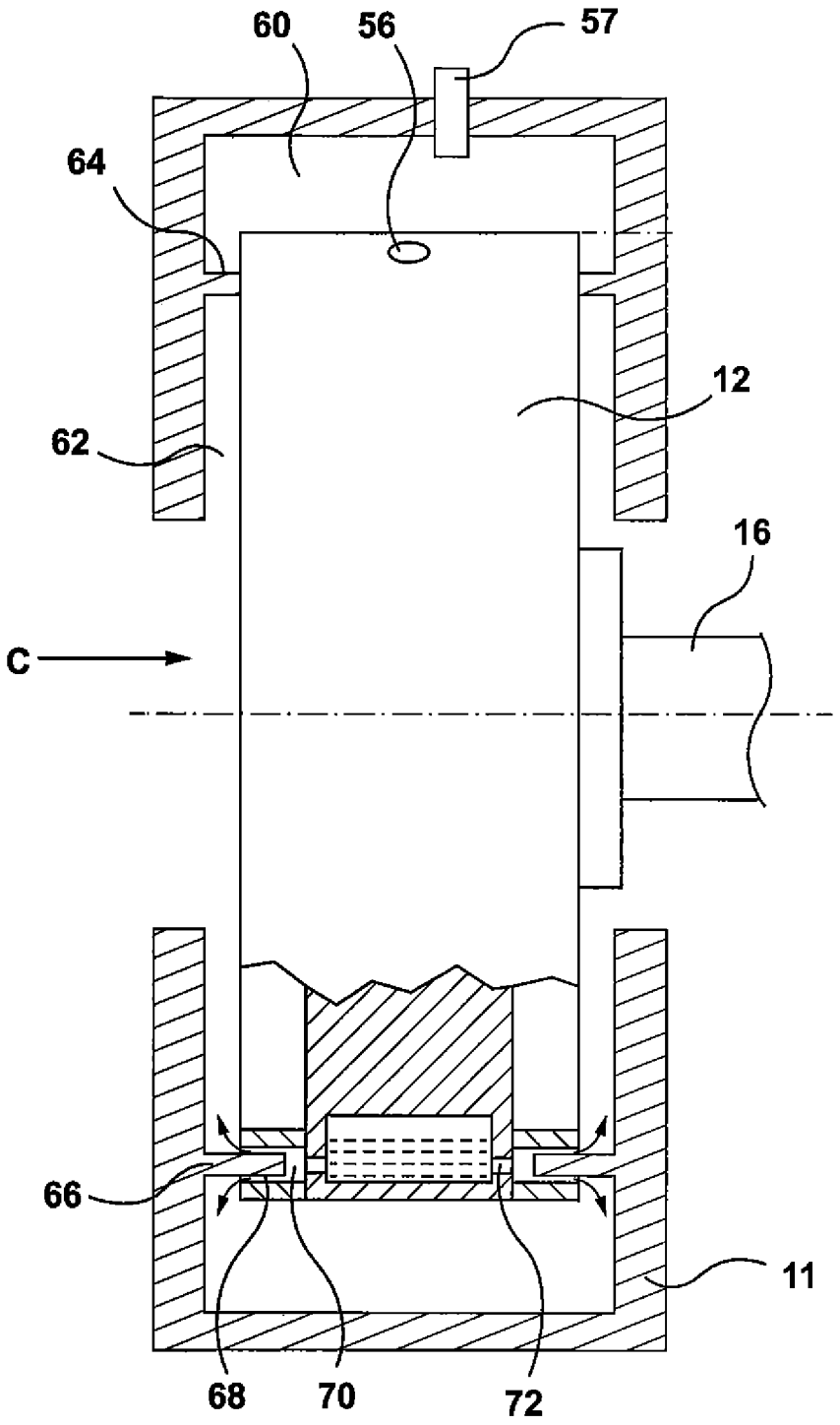
FIG. 8 is simplified partial cross-section side view of a preferred embodiment of this invention showing the positioning of the rotor within the housing and the water-seal between the rotor and the housing.
Figure 9:
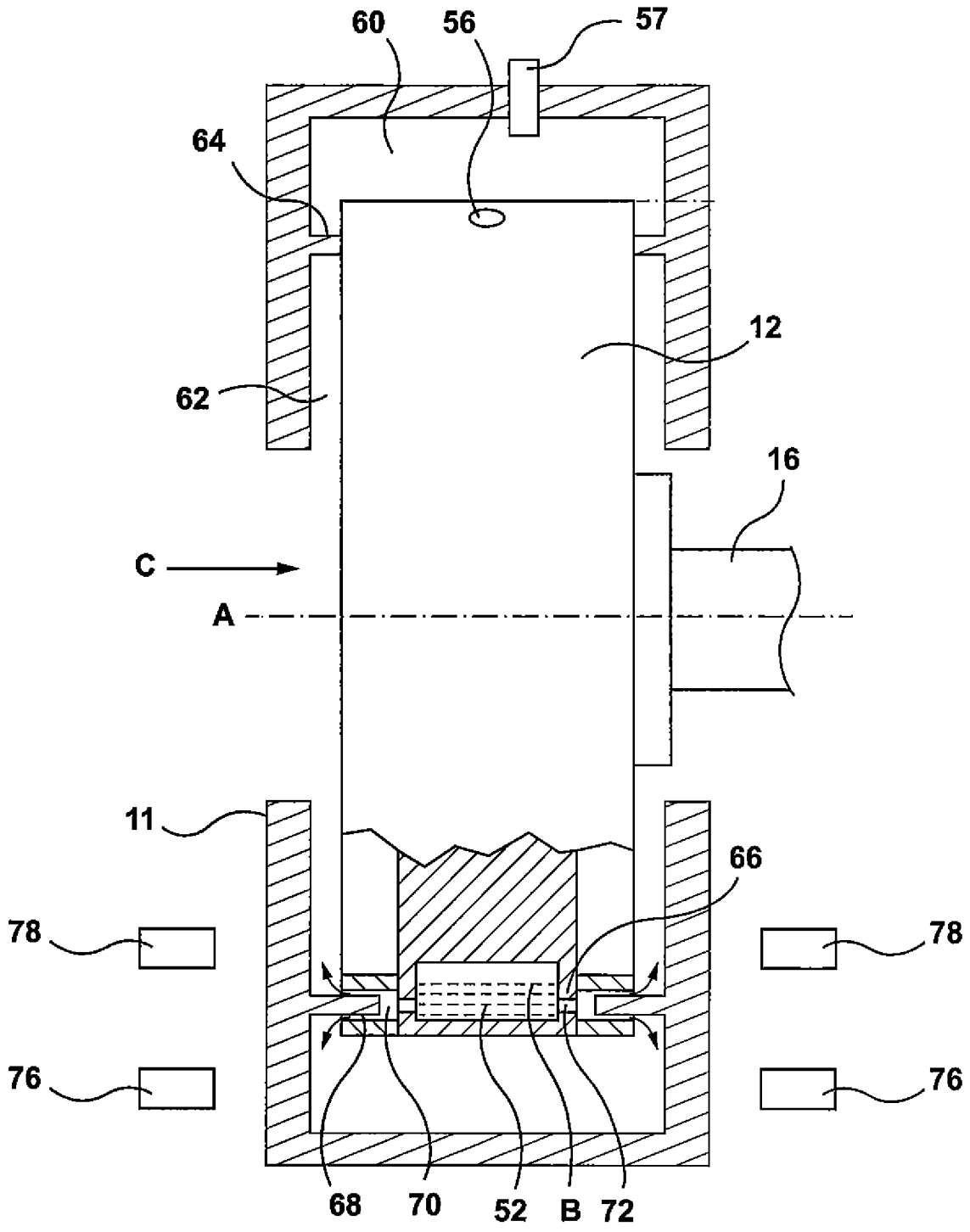
FIG. 9 is a simplified partial cross-section side view of FIG. 8 enlarged to show detail.

Preferred embodiments of the present invention will now be discussed in detail with reference to the attached drawings. As shown in FIG. 1, a centrifugal gas compressor is shown by the general reference numeral 10. The centrifugal gas compressor 10 comprises a rotor 12 which is rotated by a prime mover 14 (preferably an electric motor) about an axis. The axis is designated by the dotted line designated by reference "A" in FIG. 1 which can be seen running through the center of the rotor 12, the prime mover 14 and a drive shaft 16. A stationary housing 11 surrounds the rotor (as shown in FIG. 8 and FIG. 9) The rotor 12 defines an internal axial cavity 18 with a cylindrical surface 20 and an annular peripheral collection cavity 22. The annular peripheral collection cavity 22 defines a compressed gas outlet 56 at a position which is proximate to its axial wall 46. A liquid drain outlet 48 is provided within the collection cavity 22 proximate to its peripheral wall 50.

Figure 3:
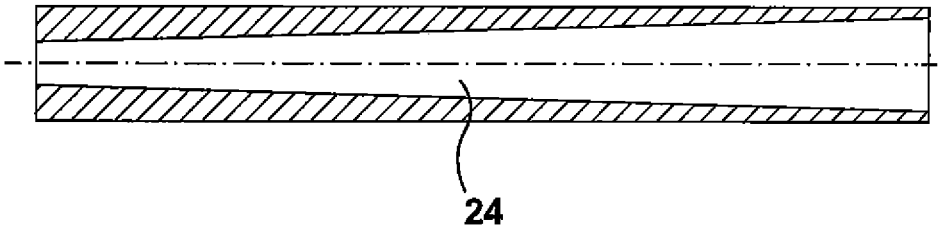
FIG. 3 is an enlarged cross-sectional of a radial tapered radial channel showing the profile of the taper.

A tapered radial channel 24 fluidly connects the internal axial cavity 18 and the collection cavity 22. In all instances the tapered radial channel 24 will be wider at its inlet 26 and will gradually narrow toward its outlet 28 at the periphery of the rotor 12. The tapered contour of the tapered radial channel 24 (FIG. 3) creates a funnel effect forcing the fluid to fill the whole cross-sectional space of each tapered radial channel as the fluid moves along its length. The cross-sectional shape of the tapered radial channels 24 need not be circular. In fact, it is advantageous for the tapered radial channels 24 to be rectangular or square in cross section. The square/rectangular shape is less prone to creating liquid turbulence in a curved channel. The size of channels will depend on the available power to the compressor, the number of channels and the diameter of the rotor. The size of the channels may range from 10 mm to 50 mm. Within any given channel the taper will be approximately 50% from inlet to outlet. Thus a channel of 10 mm at its inlet, will taper to approximately 5 mm at its outlet. It should be noted that the tapering of the tapered radial channel is not necessarily linear tapering. Instead, it is preferred for the tapering to be more pronounced at the inlet end of the channel than toward the outlet. The preferred method of construction for the rotor is 3D printing due low cost, perfect sealing of channels, and no fasteners to assemble the parts.

Figure 4:
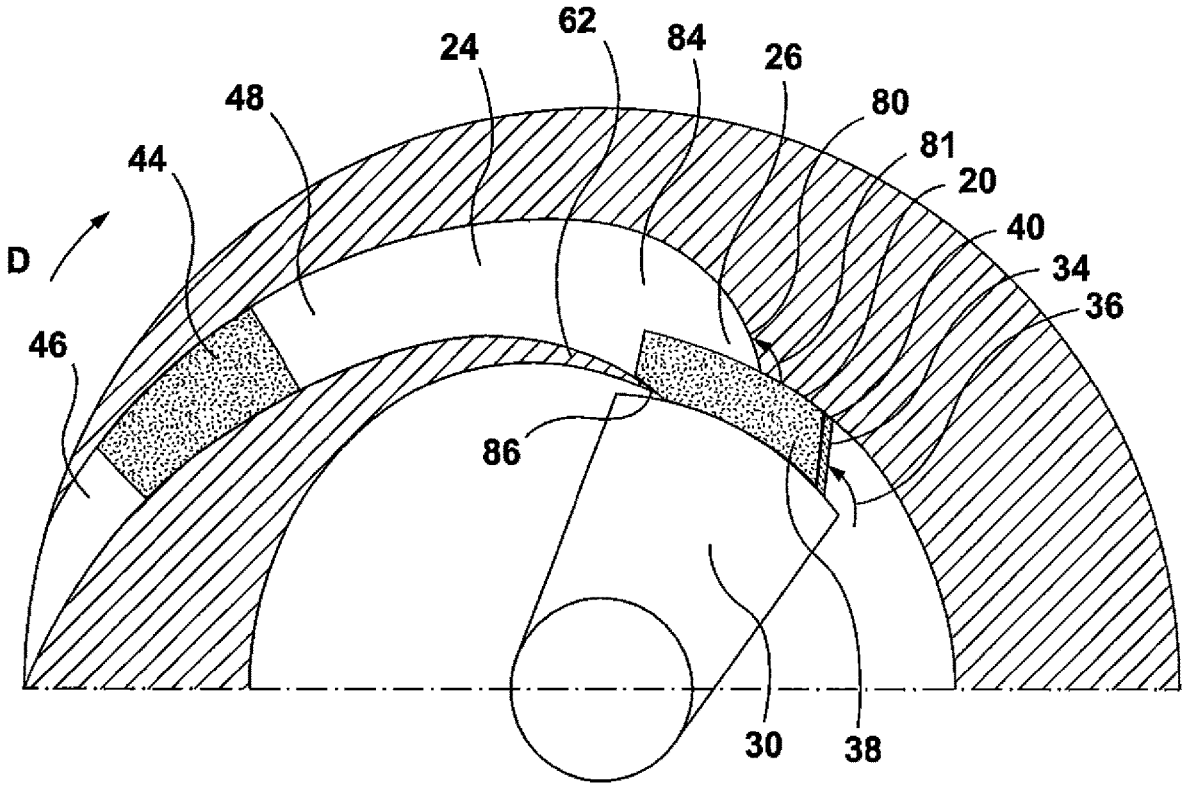
FIG. 4 is an enlarged detail of a front view of a portion of the rotor in the vicinity of the inlet of the tapered radial channel of an alternative embodiment of the invention.

As shown in FIG. 4, the inlet 26 of the tapered radial channel 24 has a leading edge 80 and a trailing edge 82 defined with respect to the direction of rotation (shown by arrow D) of the rotor 12. Preferably the leading edge 80 of inlet 26 is machined at a swept back angle (curvature of the angle is indicated by reference numeral 81) and curved backward in relation to the direction of rotation of the rotor forming a widened fluid catchment area 84 to permit more complete ingress of fluid into the inlet 26. The trailing edge 82 of the inlet 26 extends into the internal axial cavity forming a point 86 which will pass close to the fluid injector 30 to scoop fluid into the tapered radial channel 24.

Figure 2:
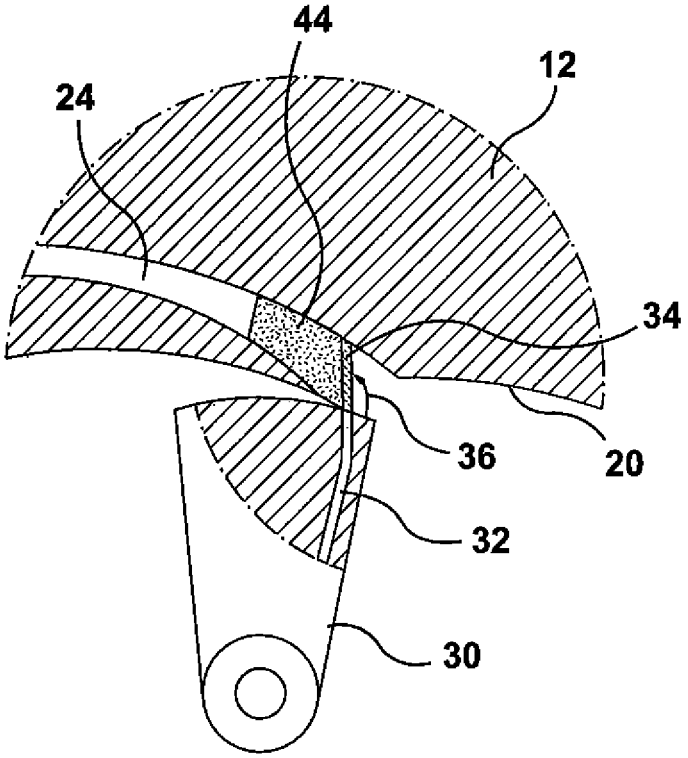
FIG. 2 is an enlarged detail of a portion of the front view of the rotor of FIG. 1, in the vicinity of the inlet of the tapered radial channel.

A fluid injector 30 is located within the internal axial cavity 18. As shown cross section in FIG. 2, the fluid injector 30 is axially placed inside the rotor 12. The travel path 32 of the injector is oriented in such a way that the fluid is projected to form a jet 34 of fluid oriented at a forward angle 36 onto the cylindrical surface 20 of the internal axial cavity 18 to sweep the processing liquid 38 along the cylindrical surface 20 in front of a leading edge 40 of the jet 34 and toward the inlet 26 of the tapered radial channel 24 as the rotor 12 rotates. The injector may optionally be referred to as a "water brush".

Figure 5:
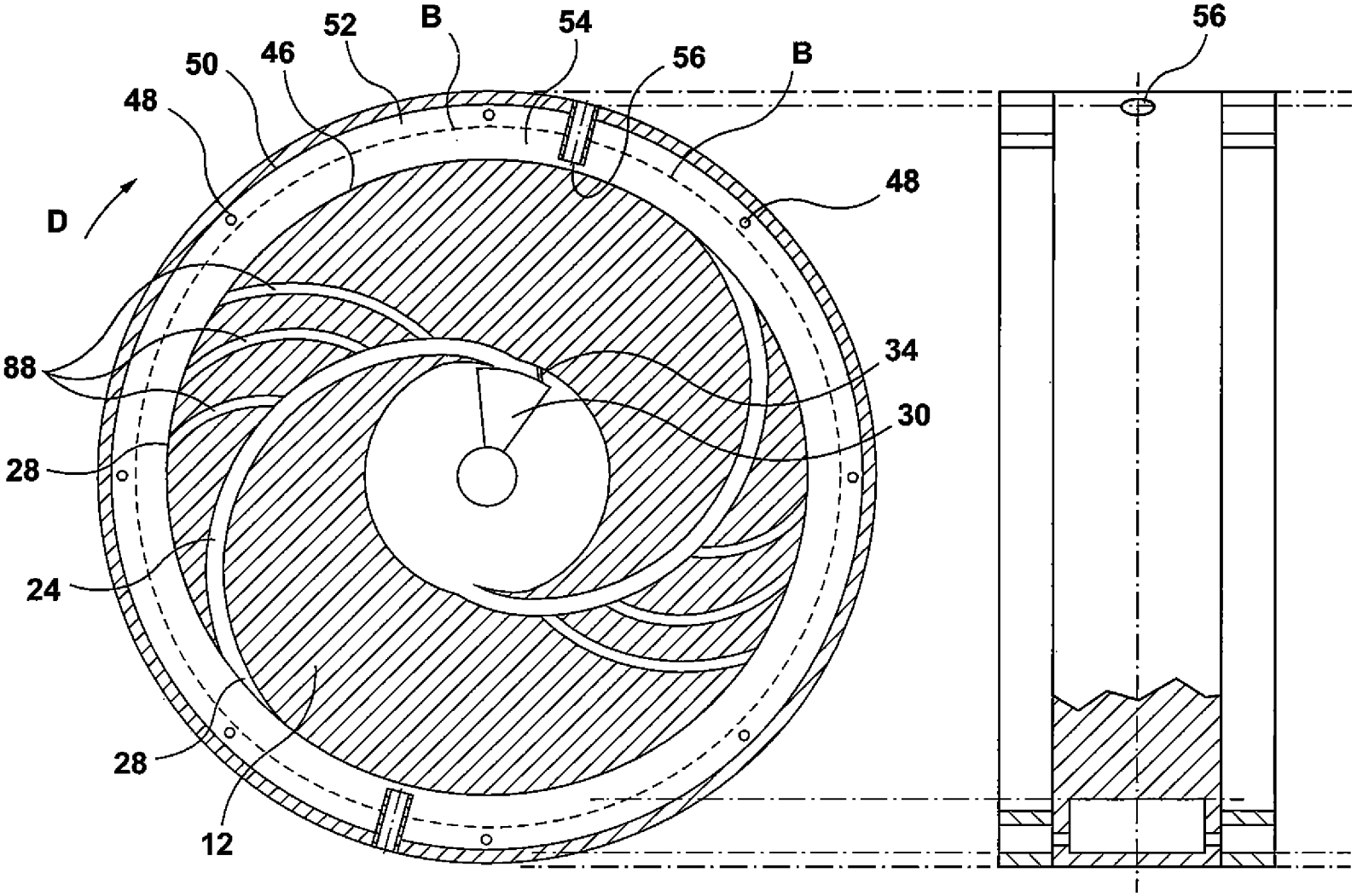
FIG. 5 is a simplified multi-angle view shown in the same manner as FIG. 1, but shown without water inside the channels of the rotor or inside the seals, and without a drive means.

In a preferred embodiment of the present invention the tapered radial channel is machined into the rotor in a back swept orientation. Put another way, the tapered radial channel 24 is curved backward along its entire length in relation to the direction of rotation of the rotor. FIG. 1 and FIG. 5 illustrate tapered radial channels having this curvature.

As seen in FIG. 4, with each rotation of the rotor 12, a portion of the processing fluid 38 is swept into the inlet 26 and travels radially through the tapered radial channel 24 as a fluid piston 44 under centrifugal force pushing and compressing a column of gas 54 entrained in front of the fluid piston 44. The fluid piston 44 will pull another column of air behind it creating an area of low pressure (suction) behind it. An area of low pressure (suction) is then created in the internal axial cavity 18, which will draw more air in through an axial air inlet port (not shown) but indicated by the directional arrow C on the side of the rotor opposite the transmission shaft 16 (as depicted in FIG. 8).

In a preferred embodiment of the present invention, the tapered radial channel 24 is branched to form a plurality of tapered radial sub-channels 88 which branch out radially and communicate at their respective distal ends with the peripheral catchment cavity 22. In operation, a fluid piston 44 traveling along tapered radial channel that branches out into sub-channels 88, will similarly branch out and send smaller water sub-pistons 44' into each sub-channel 88. When the water pistons 44 branch into smaller sub-pistons 44' the speed of the fluid movement is reduced. The speed might be reduced or increased based on the secondary channels dimensions (and not all secondary channels need to have the same dimensions or length) acting as a second stage of the compressor. Speeding up the second stage would be beneficial for low pressure compressors while slowing down would be beneficial for high final pressure where more heat is developed and the speed of the compressed air movement is reduced. The speed reduction is desirable as it allows the fluid and the gas to remain in contact with the walls of the radial channels 44 and sub-channels 88 for a longer period of time permitting cooling of the fluid and entrained gas as they travel. The branching also splits the overall flow into several smaller streams, with the additional benefit of reducing the vibration and pulsation generated by water pistons exiting the channels and sub-channels. The present invention provides near isothermal compression of gas, by virtue of increased contact time between gas and water and improved thermal transfer from the gas to the water and to the metal parts (walls, rotor) of the compressor.

Figure 6:
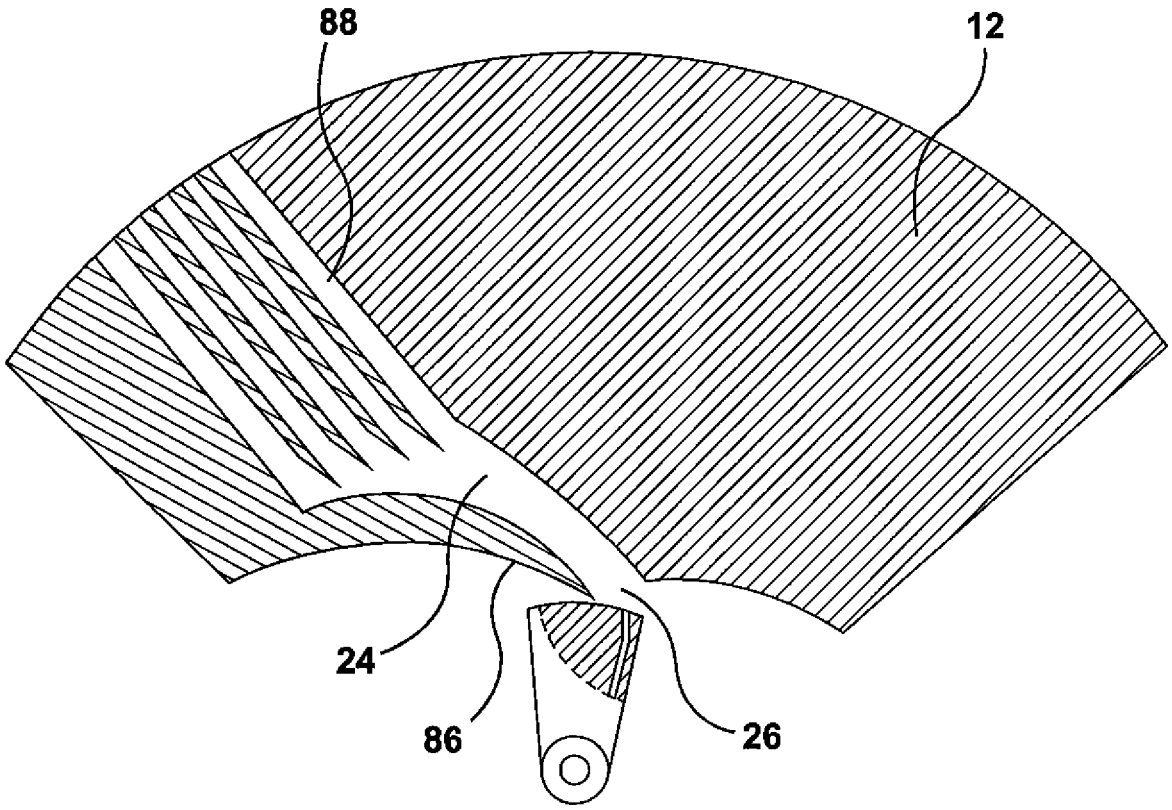
FIG. 6 is an enlarged detail of a front view of a rotor of an alternative embodiment of this invention
Figure 7:
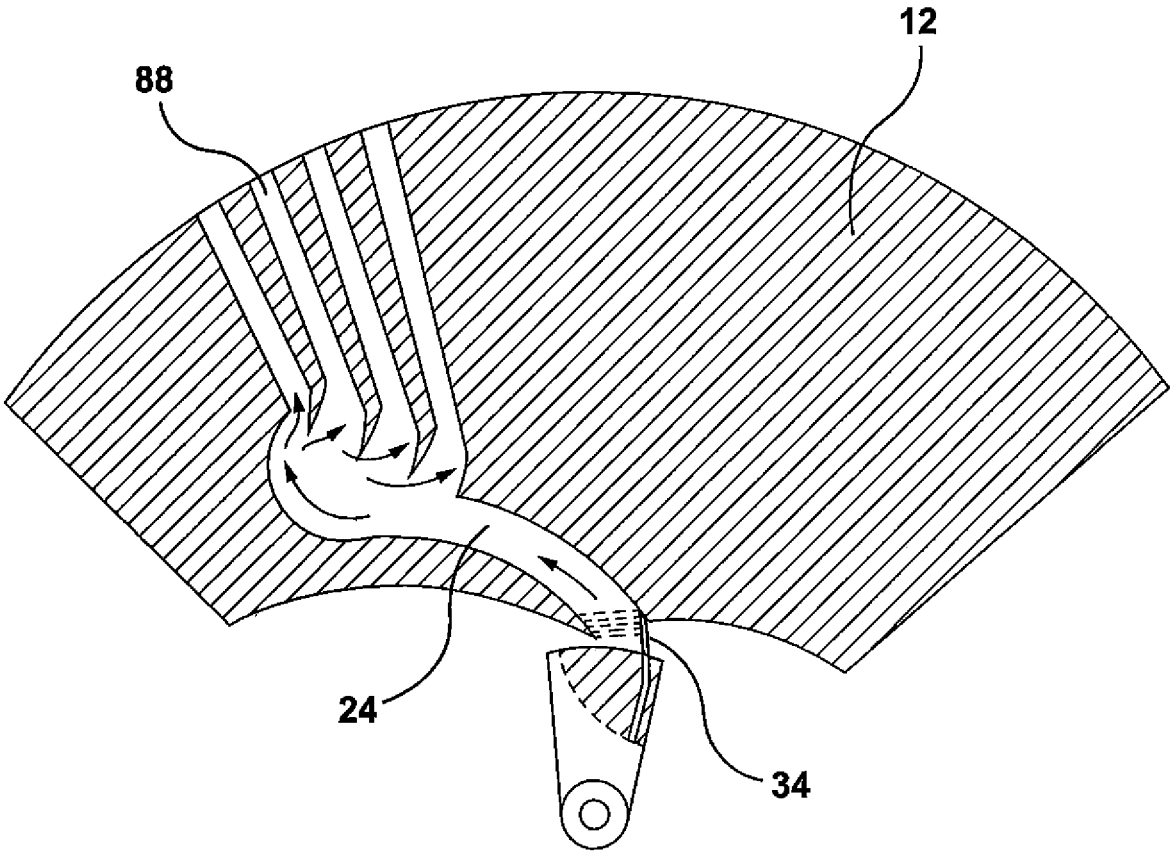
FIG. 7 is an enlarged detail of a front view of the rotor of another alternative embodiment of the invention.

In an alternative embodiments of the present invention shown in FIGS. 6 and 7, the tapered radial sub-channels 88 may be straight rather than curved after branching off of the tapered radial channel 24. An embodiment wherein the sub-channels 88 are aligned parallel to one another is shown in FIG. 6. An embodiment wherein the sub-channels 88 are aligned radially to the tapered radial channel 24 is shown in FIG. 7.

At the end of their travel through the tapered radial channels 24 and sub-channels 88, the portions of compressed air 54 and the fluid pistons 44, 44' are expelled through an the outlet 28 into the annular peripheral collection cavity 22. Centrifugal separation occurs in peripheral collection cavity 22, based on the vastly different densities of water and compressed air: the heavier water is pushed to the periphery of the rotor and forms a peripheral liquid ring 52 proximate to the peripheral wall 50 of the peripheral collection cavity 22. The compressed gas 54 is left nearer to the axial wall 46 of the peripheral collection cavity 22. In FIG. 5, the dotted line labelled with reference numeral B represents a notional boundary between the accumulated ring of liquid 52 ring, and the compressed gas 46 remaining nearer to the axial wall 46. As shown in FIGS. 1 and 5, compressed gas outlets 56 are defined at positions proximate to the axial wall 46 to protrude inside the peripheral collection cavity 22 past the depth of the accumulated ring of fluid 52 to collect the compressed gas 54 virtually free of liquid droplets. The collected compressed gas leaves the high pressure chamber 60 through the compressed gas outlets 56, from which the compressed air can be routed by high-pressure pipes to the point-of-use or to a high-pressure air storage tank (with an optional moisture-removal step inserted on the route, if needed).

The housing 11 defines a high pressure chamber disposed peripherally and a low pressure chamber 62 disposed centrally and axially, separated by a cylindrical wall 64. A seal 66 is provided within the cylindrical wall between the rotor 12 and the housing 11. Preferably the seal is a water seal comprising a stationary lip 68 formed by the cylindrical wall 64 which projects into a mating groove 70 defined on the rotor 12 at the periphery thereof. In operation, the water-seal is maintained permanently flooded with high pressure water (which serves as both lubricant and as a sealing media within the water-seal), preferably by routing high pressure water from the liquid ring 52 accumulated inside the peripheral collection cavity 22, to flow out, via several orifices 72, into the mating groove 70 machined on the outside of the rotor 12. The orifices 72 are positioned within the peripheral collection cavity 22 so as to always be submerged within the liquid ring 52 of water, to avoid leakage of compressed air through the seal. Keeping the water seal 66 between the spinning rotor 12 and the stationary housing 10 always flooded with high pressure water allows rotation of the rotor with minimal friction and maintains a good seal between the high-pressure chamber 60 and the low pressure chamber 62 of the housing 10. The outflow of water through orifices 72 also ensures that water does not over accumulate inside the peripheral collection cavity 22, so that the water level (the thickness of the liquid ring 52) is maintained at the desired level by bleeding out water continuously through the water-seal. By its intrinsic design, the water seal (described above) used in a preferred embodiment of this invention will continuously leak water into both the high-pressure chamber 60 and the low pressure chamber 62, as depicted in FIG. 8 and FIG. 9. This water flowing out from the seal 66 is collected in two reservoirs, one first reservoir 76 for the high-pressure chamber 60 and second reservoir 78 for the low pressure chamber 62. The collected water in the liquid ring 52 is quite warm (the result of the fact that a significant amount of the heat of compression was transferred from the compressed air to the outflowing water), therefore it cannot be directly redirected as feed-water back to the intake of the compressor (unless cooling facilities exist to bring down the temperature of such residual water collected from the compressor). This water is pressurized so no additional pumping is needed after starting the compressor. The compressor will have an after cooler to reduce the water temperature so it can be reused A method for compressing a gas fed into a rotor rotated by a prime mover about an axis, said rotor defining an internal axial cavity 18 with a cylindrical surface 20, the method comprising the following steps. The first step is providing a tapered radial channel fluidly connecting said internal axial cavity and said annular peripheral collection cavity. A jet 34 of processing liquid is injected into the internal axial cavity 18 oriented at a forward angle 36 onto the cylindrical surface 22 of the internal axial cavity to sweep the processing liquid along 38 said cylindrical surface 28 in front of a leading edge 40 of the jet 34 and toward an inlet 26 of the tapered radial channel 24 as the rotor 12 rotates. With each rotation of the rotor, a portion of the processing fluid flows into the inlet 26 of the tapered radial channel 24 forming a fluid piston 44 and entraining a column of air (gas) 45 in front of it within the tapered radial channel. The fluid piston 44 travels radially through the tapered radial channel 24 under centrifugal force pushing and compressing the column of gas 45 entrained in front of said fluid piston 44. After travelling the length of the tapered radial channel 24 and tapered sub-channels 88 the portion of processing fluid is expelled along with the entrained column of gas into the annular peripheral collection cavity 22. Centrifugal separation occurs forming by centrifugal force a peripheral liquid ring 52 proximate to the peripheral wall 50 of the annular peripheral collection cavity and leaving the collected compressed gas 54 to be drawn off through a compressed gas outlet 56 located within the annular peripheral collection cavity 22 at a position proximate to an axial wall 46 of said annular peripheral collection cavity. After the compressed gas 54 leaves the peripheral collection cavity 22 through the compressed gas outlet 56 it is drawn out of the housing 11 through outlet 57 for downstream use.

In operation, from a standstill and without water flow, primary mover (motor) 14 is turned on and the rotor 12 starts spinning. Next, the flow of process water (preferably regular municipal tap water, or chilled water if available is slowly turned on to a present flow rate. The water will be recycled through the compressor; chilled water or tap water can be used when starting the compressor so no additional water pump is need. The water is fed to the intake at the base (axial end) of the fluid injector, which has machined inside it a water channel 32 leading to a specially angled opening in the outer edge thereof, whereby a jet 34 of water is injected into the internal axial cavity 18 at a forward angle 36 onto the cylindrical surface 20. In operation, the fluid injector 30, together with the jet 34 of fluid projecting from it form a "water brush". The relative movement of the "water brush" against the cylindrical surface 20 of the spinning rotor 12 effects a "sweeping action" on the water on the inner cylindrical surface 20 ensuring that substantially all of the fluid accumulates in front of the leading edge of the jet 34. At the end of their travel through the channels 24 and sub-channels 88, the compressed air and the water pistons are moved into the peripheral collection cavity 22. Centrifugal separation occurs based on the vastly different densities of water and compressed air: the heavier water is pushed to the periphery of the rotor and forms a peripheral liquid ring under the effect of the centrifugal force. The compressed gas, virtually free of water, is continuously collected by one or more intermediate compressed gas outlets 56, which are radial tubes that protrude from the outside of the rotor to the inside of the peripheral collection cavity 22 protruding past the level of the accumulated fluid ring 52 and into the layer of compressed gas 54, so that the compressed gas can flow out of the of the rotor and the fluid is prevented from escaping through the compressed gas outlets, and instead escapes the peripheral collection cavity through liquid drain outlets 48.

In the operation of a preferred embodiment of the centrifugal gas compressor, at least two input parameters can be controlled by the operator, according to the desired need for a certain air flow rate (cfm), air temperature, pressure, etc. Firstly, the rotation speed (rpm) of the motor 14 (and/or of the rotor 12) can be adjusted if required, with higher rpm generally resulting in a higher air pressure for the all parameters being kept constant. Secondly, by adjusting the amount of water (intake water flowrate), the operator can adjust the amount of air output (flow rate) from the compressor: when more water is injected into the inner cavity of the rotor according to this invention, there will be less spacing between consecutive water pistons within the same channel, and less remaining room for the air (which situation, if pushed to extreme, could reach a point where the rotor's internal cavity and channels are fully flooded with water, with no air intake or air output). When the operator decreases the flow rate of intake water, there will be more room for air, and more spacing between consecutive water pistons within the same channel, leading to an increase in compressed air output (up to a maximum air flow rate, corresponding to the minimum flow rate of water that could still maintain a minimum liquid ring level in the rotor and could still bleed out at a rate sufficient to keep the water-seal operational for the system to run). Accordingly, a manual or automated valve on the water intake circuit can preferably be used to control the amount of air output (flow rate) from the compressor, while an optional variable speed motor (or variable speed drive/transmission) can additionally be used to vary the rotor spinning rate for further control for this invention.

FIG. 4 depicts a particular alternative embodiment of this invention, namely a blower optimized to output air at high-flow and low-pressure; to achieve this purpose, the rotor inside such blower is fitted with one or more large tapered channels (preferably without branches). With such large tapered channels, and with the rotor spinning at a fast rpm, the water slug (piston) formed at the entrance of the channel can almost be perceived as "standing still" from the perspective of an external observer, whereas it is the rotor (and the channel machined within) which appears to move while the water piston is perceived to be almost stationary, with not much radial movement (even though, the movement of the water slug relative to the channel's inner walls is theoretically equivalent to the fast movement of a water piston inside a channel). The end result is efficient pushing of high volumes of air by each water slug formed inside the channel, due to the fact that every water slug experiences very little mechanical energy loss due to friction and back pressure while traveling from one end to the other of the channel thus pushing the air in front of it from the intake to the high pressure side.

I claim:

1. A centrifugal gas compressor fed with a gas and a processing liquid comprising:

a rotor rotated by a prime mover about an axis, said rotor defining an internal axial cavity with a cylindrical surface, an annular peripheral collection cavity, and a tapered radial channel, wherein the tapered radial channel fluidly connecting said internal axial cavity and said annular peripheral collection cavity;

a fluid injector located within the internal axial cavity and oriented at a forward angle to direct a jet of the processing liquid onto the cylindrical surface of the internal axial cavity to sweep the processing liquid along said cylindrical surface in front of a leading edge of the jet and toward an inlet of the tapered radial channel as the rotor rotates;

a compressed gas outlet defined within the annular peripheral collection cavity at a position proximate to an axial wall of said annular peripheral collection cavity; and, a liquid drain outlet within the annular peripheral collection cavity at a position proximate to a peripheral wall of said annular peripheral collection cavity;

whereby with each rotation of the rotor, a portion of the processing liquid is swept into the inlet of the tapered radial channel and travels radially as a fluid piston under centrifugal force pushing and compressing a column of the gas entrained in front of said fluid piston and is expelled into the annular peripheral collection cavity and forms a peripheral liquid ring proximate to the peripheral wall of the annular peripheral collection cavity, leaving the gas that is compressed to be drawn off through the compressed gas outlet.

2. The centrifugal gas compressor according to claim 1, further comprising a gas inlet positioned within the internal axial cavity.

3. The centrifugal gas compressor according to claim 2, wherein the inlet of the tapered radial channel has a leading edge and a trailing edge defined with respect to a direction of rotation of the rotor.

4. The centrifugal gas compressor according to claim 3, wherein the leading edge of the inlet is curved backward in relation to the direction of rotation of the rotor forming a widened fluid catchment area.

5. The centrifugal gas compressor according to claim 4, wherein the trailing edge of the inlet extends into the internal axial cavity forming a point which will pass close to the injector as the rotor rotates to scoop the processing liquid-fluid into the tapered radial channel.

6. The centrifugal gas compressor according to claim 1, wherein the tapered radial channel is rectangular in cross section.

7. The centrifugal gas compressor according to claim 1, wherein the tapered radial channel is curved along its entire length.

8. The centrifugal gas compressor according to claim 1, wherein the tapered radial channel is branched to form a plurality of tapered radial sub-channels.

9. The centrifugal gas compressor according to claim 8, wherein the tapered radial sub-channels are curved.

10. The centrifugal gas compressor according to claim 8, wherein the tapered radial sub-channels are straight.

11. The centrifugal gas compressor according to claim 8, wherein the tapered radial sub-channels are aligned parallel to one another.

12. The centrifugal gas compressor according to claim 8, wherein the tapered radial sub-channels are aligned radially to the tapered radial channel.

13. The centrifugal gas compressor according to claim 1, further comprising a housing surrounding the rotor, which housing remains stationary when the rotor is rotated.

14. The centrifugal gas compressor according to claim 13, wherein the housing defines a low pressure chamber disposed centrally and axially, and a high pressure chamber disposed peripherally, separated by a cylindrical wall within the housing.

15. The centrifugal gas compressor according to claim 13, further comprising a seal between the rotor and the housing.

16. The centrifugal gas compressor according to claim 15, wherein the seal is a water seal comprising a stationary lip formed by a cylindrical wall which projects into a mating groove defined on the rotor at a periphery thereof, said mating groove being filled with water.

17. A method for compressing a gas fed in a rotor rotated by a prime mover about an axis, said rotor defining an internal axial cavity with a cylindrical surface, the method comprising the steps of:

providing a tapered radial channel fluidly connecting said internal axial cavity and an annular peripheral collection cavity;

injecting into the internal axial cavity a jet of processing liquid oriented at a forward angle onto the cylindrical surface of the internal axial cavity to sweep the processing liquid along said cylindrical surface in front of a leading edge of the jet and toward an inlet of the tapered radial channel as the rotor rotates;

sweeping, with each rotation of the rotor, a portion of the processing fluid into the inlet of the tapered radial channel;

causing the portion of the processing liquid fluid to travel radially as a fluid piston under centrifugal force pushing and compressing a column of the gas entrained in front of said fluid piston;

expelling the portion of the processing fluid and the column of the gas into the annular peripheral collection cavity;

forming by centrifugal force a peripheral liquid ring proximate to a peripheral wall of the annular peripheral collection cavity;

leaving the compressed gas to be drawn off through a compressed gas outlet located within the annular peripheral collection cavity at a position proximate to an axial wall of said annular peripheral collection cavity.

* * * * *